United States Patent [19]

Davidoff

[11] 4,039,410

[45] Aug. 2, 1977

[54] ELECTROCLEANING PROCESS

[75] Inventor: Charles Davidoff, Port Washington, N.Y.

[73] Assignee: Bundy Corporation, Detroit, Mich.

[21] Appl. No.: 694,070

[22] Filed: June 7, 1976

[51] Int. Cl.[2] ..... C25F 1/00; C25F 5/00

[52] U.S. Cl. ..... 204/141.5; 204/32 R; 204/146

[58] Field of Search ..... 204/32 R, 141.5, 146, 204/144.5

[56] References Cited

U.S. PATENT DOCUMENTS

| | | | |
|---|---|---|---|
| 1,917,022 | 7/1933 | Dunn | 204/144.5 |
| 2,422,902 | 6/1947 | Huston | 204/141.5 |
| 3,528,896 | 9/1970 | Davidoff et al. | 204/141.5 |
| 3,627,654 | 12/1971 | Petit | 204/141.5 |
| 3,663,386 | 5/1972 | Otrhalek | 204/141.5 |

*Primary Examiner*—T. M. Tufariello

*Attorney, Agent, or Firm*—Harness, Dickey & Pierce

[57] ABSTRACT

A process for electrocleaning articles comprised of a substrate having a copper coating thereover to remove adherent and embedded contaminating carbon particles from the coating, rendering the article in suitable condition for further electroplating operations. The electrocleaning treatment includes immersing the article in an aqueous alkaline solution containing a controlled effective amount of an inorganic complexing agent possessed of copper solubilizing properties and effective to retain the solubilized copper in solution in the form of a complex. The article is cathodically electrified continuously or on an intermittent basis for at least a portion of the period while immersed in the aqueous alkaline solution to accelerate the solubilization of the copper and the dislodgment and removal of the contaminating carbon particles, whereafter the electrocleaned article is rinsed.

18 Claims, 3 Drawing Figures

ELECTROCLEANING PROCESS

BACKGROUND OF THE INVENTION

The present invention is particularly applicable but not necessarily limited to a process for producing corrosion resistant terne plated copper brazed multi-ply steel tubing of the general type as shown and described in U.S. Pat. Nos. 1,892,607; 2,092,557 and 3,875,027, all of which are assigned to the assignee of the present invention. Multi-ply steel tubing of the foregoing type is in widespread commercial use, particularly for fabrication of automobile hydraulic brake lines and fuel lines. The multi-ply copper brazed steel structure of such tubing provides for excellent mechanical properties and formability, as well as a high resistance to vibration fatigue, Further improvements in the resistance to corrosion of multi-ply tubing of the foregoing type has heretofore been provided by applying a copper and/or nickel electroplate to the surface of the welded multi-ply tubing, followed by a coating of a hot terne alloy in accordance with the procedure as more fully described in U.S. Pat. No. 3,875,027, the substance of which is incorporated herein by reference. Processing difficulties have been encountered in producing such corrosion-resistant tubing in accordance with the aforementioned patented process due to the presence of minute particles of carbon embedded in the surface of the copper coating on the brazed tubing, detracting not only from attaining a uniform inpervious copper and/or nickel electroplating, but also causing a contamination of the nickel and copper plating solutions, whereby less than optimum results are obtained. The presence of such carbon particles on the tube surfaces and the contamination of the electrolyte has necessitated the use of relatively slow production rates to achieve satisfactory electrodeposited coatings, which has detracted from the economics of the manufacturing process.

The presence of such minute carbon particle contaminants on and embedded in the surface of the outer copper layer is derived from the deposition of carbon or a carbonaceous material on the surface of the tubing prior to the furnace brazing operation, forming a carbon film which retains the molten copper layer in position on the tubing surfaces, minimizing undesirable flow or migration, thereby avoiding the formation of bare or uncoated surface areas. The particular materials and conditions for applying the carbon film are more fully described in U.S. Pat. No. 2,092,557, the substance of which is incorporated herein by reference.

In any event, conventional cleaning treatments of the type heretofore known in the art have been unsuccessful in appreciably removing the minute carbon particles embedded in the copper layer as a result of the solidification of the molten copper during the cooling stage of the brazing operation. The present invention overcomes many of the problems and disadvantages associated with prior art cleaning techniques by providing a method which is quick, efficient and effective to remove substantially all of the residual carbon contaminants from the surfaces of copper brazed multi-ply steel tubing, enabling increased production capacity and improved results in the corrosion resistance of the electroplated and terne coated tubing due to the improved uniformity and continuity of the copper and/or nickel electroplatings deposited thereon.

SUMMARY OF THE INVENTION

The benefits and advantages of the present invention are achieved by a process which is broadly applicable for cleaning embedded contaminants in copper surfaces and more particularly, for removing embedded minute particles of carbon in copper coated ferrous substrates and steel tubing to render such surfaces more amenable to further treatment including electroplating operations and the like. The cleaning treatment comprises contacting the contaminated copper surfaces with an aqueous alkaline solution containing a complexing agent, of which alkali metal pyrophosphates constitute preferred materials, and which are characterized as possessing copper solubilizing properties so as to undercut the copper adjacent to the particles, enabling a release of the entrapped or embedded particulate contaminants from the surface. The complexing agent is further characterized as one which forms aqueous alkaline solution soluble copper complexes, and preferably also iron complexes of any iron dissolved, and which soluble metal complexes can readily be washed or rinsed from the surface by water at the completion of the treatment.

The aqueous alkaline cleaning solution further includes an alkaline agent such as an alkali metal hydroxide, which also contributes to the cleaning or the cleansing action, as well as adjusting the pH of the solution from a permissible operating range of about 9 up to about 12, with pH levels of about 11 generally being preferred. The aqueous cleaning solution may also contain as an optional constituent, minor amounts of various wetting agents of the types commercially available and well known in the art for use in alkaline cleaning solutions.

In the practice of the process, the surface to be cleansed is immersed or flooded with the aqueous alkaline solution and is electridied cathodically on a continuous or intermittent basis during at least a portion of the time it is disposed in contact with the aqueous alkaline solution to further facilitate the copper dissolution and complexing reaction and to generate hydrogen at the surface to assist in dislodging the embedded contaminant particles as they become released. In accordance with a preferred practice of the present method, the electrocleaning treatment is carried out in three separate stages, with the workpiece being cathodically charged continuously in the first stage, cathodically charged on an intermittent basis in the second stage, and cathodically charged on a continuing basis in the third stage, followed by one or a plurality of water rinse treatments. The electrocleaning treatment is preferably performed employing solutions ranging in temperature from about 100° F up to the solution boiling point and utilizing current densities of from about 75 up to about 600 amperes per square foot (ASF).

In addition to effecting a substantially complete removal of adherent and embedded contaminating carbon particles, the electrocleaning treatment further imparts a bright surface to the cleaned part as opposed to a matte-type surface. Additional benefits and advantages of the present invention will become apparent upon a reading of the description of the preferred embodiment taken in conjunction with the accompanying drawing.

DESCRIPTION OF THE PREFERRED EMBODIMENTS

The electrocleaning process of the present invention will hereinafter be described with particular emphasis on its adaptation to the manufacture of multi-ply copper brazed steel tubing which subsequent to the electrocleaning treatment, is further electroplated and then terne coated to produce a high strength corrosion resistant tubing of the type suitable for use as brake lines and fuel lines in automobile vehicles. It will be understood, however, that the electrocleaning process can be empolyed with equal benefit for removing minute embedded contaminating particles from copper surfaces in general, whereby such surfaces are rendered amenable to further processing, particularly electroplating operations and the like.

Figure 1:
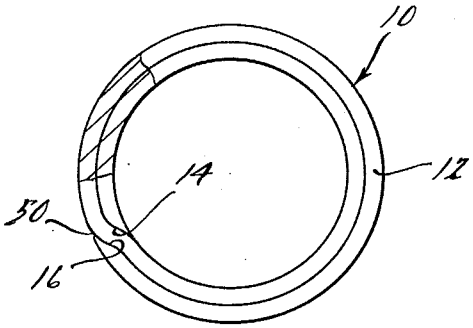
FIG. 1 is an end elevational view, partly in section, illustrating a multi-ply brazed steel tube of the type to which the process of the present invention is particularly applicable.

Referring now in detail to the drawing, and as shown in FIG. 1, a typical multi-ply copper brazed steel tubing 10 comprises a generally spiral wound copper plated steel strip 12, formed with a chamferred inner edge 14 and outer edge 16 which during the roll-forming operation, are deformed so as to define a smooth circular inner surface and outer surface of the tubing. Tubing of the type shown is generally commercially referred to as "Bundy" and "Bundyweld" tubing, and is more fully defined in U.S. Pat. Nos. 1,431,368 and 1,892,607, to which reference is made for further details of the tubing fabrication process. Suffice it to say, the steel strip 12 is preferably comprised of a low carbon steel, such as AISI-1008, which is preliminarily copper plated to a thickness, such as 0.15 mil, and thereafter is roll-formed into the spiral configuration as shown in FIG. 1. The preliminarily formed tubing thereafter is furnace brazed to cause the copper plating to melt and to flow between the overlapping surfaces, wherein upon cooling, a continuous high strength brazed joint is formed.

The furnace brazing operation is carried out in a nonoxidizing atmosphere at a temperature above 1983° F, the melting point of copper. To avoid undesirable flow or migration of the molten copper on the outer surface of the tubing during the furnace brazing operation, a carbon coating or film is deposited on the surface of the tubing, as more fully described in U.S. Pat. No. 2,092,557, which serves to hold or fix the copper coating in position. The carbon coating can be applied by any one of a variety of techniques as disclosed in the aforementioned patent, the contents of which are incorporated herein by reference Such techniques including the application of carbonaceous coating on the tubing surface, which is adapted to thermally decompose during heating in the brazing furnace, leaving a residuary carbon film on the surface of the tubing before the tubing attains the temperature at which the copper coating melts. Such carbonaceous coatings including lacquers, mineral oils, vegetable oils, animal fats, etc., may be further combined with carbon materials such as lamp black itself, which forms an adherent carbon film after ther thermal decomposition and/or vaporization of the liquid carrier.

Figure 2:
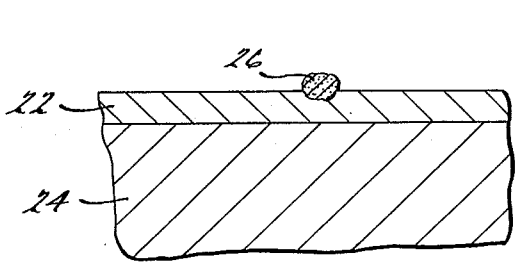
FIG. 2 is a fragmentary, magnified, vertical cross sectional view of the surface of the copper coated steel tube of FIG. 1 illustrating the manner by which particulate contaminant particles are disposed in embedded relationship in the surface of the copper layer.
Figure 3:
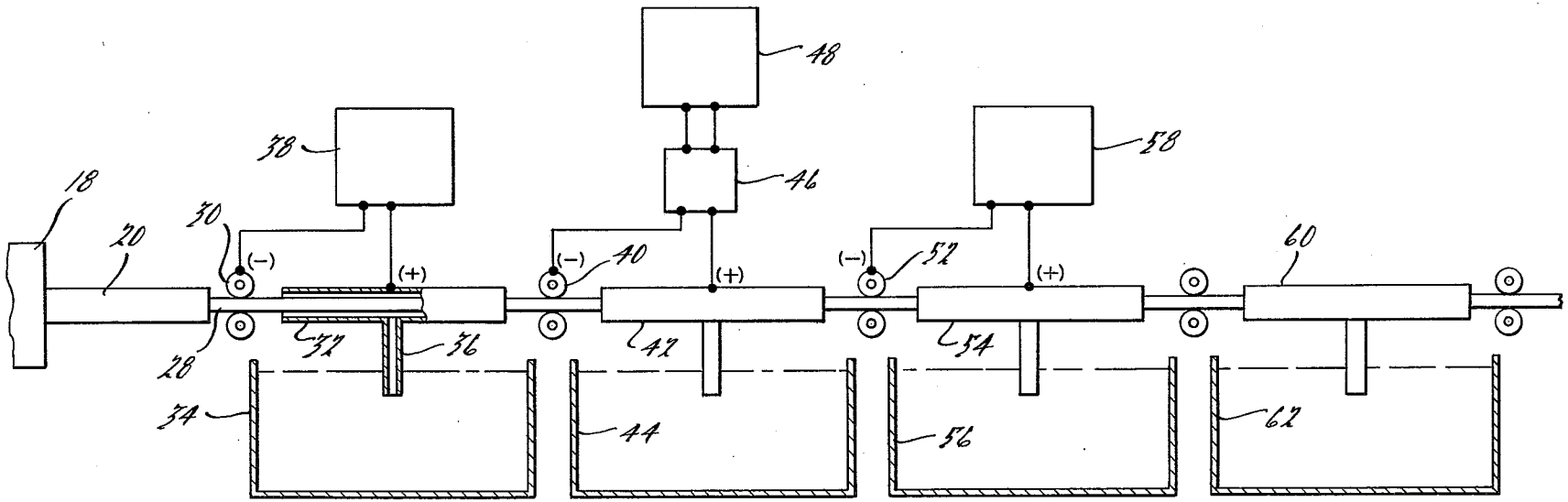
FIG. 3 is a fragmentary, diagrammatic flow diagram illustrating a preferred embodiment of the electrocleaning process of the present invention.

The furnance brazing operation of the carbon coated multi-ply copper plated tubing can appropriately be achieved in a muffle furnace 18, as fragmentarily shown in FIG. 3, provided with a nonoxidizing or reducing atmosphere, whereafter the tubing enters an elongated cooling chamber 20 which also is provided with a nonoxidizing or reducing atmosphere to effect a cooling of the tubing to a temperature of below about 200° F before being exposed to air. The cooled furnace brazed tubing, as depicted in FIG. 2 of the drawing, comprises an outer layer 22 comprised of relatively pure copper and an underlying stratum 24 consisting of an interdiffused iron-copper alloy. A contaminating particle 26, such as a carbon particle, is shown embedded in and mechanically interlocked in the copper layer 22 as a result of the solidification of the molten copper layer around the partially submerged particle at the conclusion of the furnace brazing operation. Embedded particles, as illustrated in FIG. 2, cannot be removed by known prior art cleaning techniques. Moreover, the colloidal size of such particles prevents mechanical separation such as by filtration of electroplating solutions which have become contaminated with such particles during the course of the copper or nickel electroplating of the copper brazed steel tubing surfaces.

In accordance with a preferred embodiment of the electrocleaning treatment of the present invention, the copper coated tubing 28 emerging from the cooling chamber 20, as shown in FIG. 3, passes between a drive roll and electrical contact assembly 30, and thereafter extends through a tubular chamber 32 filled with an alkaline electrocleaning solution. The tubular chamber 32 is disposed above a receptacle 34, from which the solution is pumped through an upright supply conduit 36 into the central part of the tubular chamber 32, which thereafter flows out the opposed ends thereof and is recovered in the receptacle. One of the drive rolls 30 is electrically connected to a rectifier 38 to apply a constant negative or cathodic charge to the tubing, while the second terminal of the rectifier 38 is connected to the tubular chamber, effecting a positive or anodic electrification thereof. The voltage of the direct electric current is controlled so as to provide a current density which may range from as low as about 75 amperes per square foot (ASF) to as high as about 600 ASF, while current densities of about 250 to about 450 are usually preferred. The electrification in the first stage represented by the tubular chamber 32, receptacle 34 and rectifier 38, is preferably controlled at a constant cathodic potential, causing a vigorous evolution of hydrogen gas bubbles at the surface of the tubing to facilitate dislodgment of the particles entrapped or embedded in the surface stratum of the copper layer.

The aqueous alkaline solution empolyed in the first stage electrocleaning step contains a small but effective concentration of a complexing agent characterized as one which provides for a slight solubilizing of the copper layer and the formation of aqueous alkaline solution soluble copper complexes which remain dissolved in the solution and which readily can be rinsed by water from the surfaces of the tubing at the completion of the electrocleaning operation. Of the various complexing agents suitable for this purpose, inorganic alkali metal phosphate-type compounds have been found particularly satisfactory including alkali metal tetrapyrophosphate such as sodium tetrapyrophosphate, ($Na_4P_2O_7$);

alkali metal trimetaphosphate such as sodium trimethaphosphate, ($Na_3P_3O_9$); alkali metal triphosphites such as sodium triphosphite, ($Na_5P_3O_{10}$); sodium gluconate; the sodium salts of E.D.T.A., amino triacetic acid, hydroxy ethyl amino diacetic acid, methyl amino diacetic acid, E.D. tetrapropionic acid, glycine, and the like. The term "alkali metal" as herein employed and as used in the subjoined claims is used in its broad sense and includes alkali metals such as sodium, potassium, and lithium, as well as the ammonium radical ($NH_4^+$).

The use of an alkali metal tetrapyrophosphate effects an aqueous alkaline complex of copper and iron to form such as $Cu(P_2O_7)_2^{-6}$ and $Fe(P_2O_7)_2^{-5}$. The concentration of complexing agent in the aqueous alkaline solution can range from about 10 grams per liter up to about 100 grams per liter, and preferably from about 30 to about 60 grams per liter. The solution is applied to the surface of the tubing at a temperature ranging from about about 100° F up to the boiling point of the solution. Temperatures generally below about 100° F are undesirable due to the lower solubility of the copper and the corresponding increased time necessary to effect the necessary degree of solubilization to release the embedded and entrapped contaminating particles in the surface thereof. On the other hand, temperatures approaching the boiling point of the solution are usually not necessary since temperatures below the boiling point, such as about 180° F, are satisfactory. Generally, solution temperatures ranging from about 145° to about 165° F are preferred for most conditions.

In addition to the complexing or chelating agent, the aqueous solution may also contain controlled amounts of alkali metal hydroxides which contribute a cleaning action to the solution and also provide the requisite pH adjustment to maintain the solution within a permissible range of from about 9 pH up to about 12 pH. Generally, sodium hydroxide or caustic constitutes the preferred material and is employed in amounts to preferably maintain the pH of the solution at approximately 11. In addition to the complexing agent and alkali hydroxide for pH adjustment, the aqueous solution may further optionally contain controlled amounts of wetting agents. The use of certain complexing agents such as sodium tetrapyrophosphate have exhibited satisfactory wetting action per se as not to require any supplemental wetting agent. In some instances, however, improved wetting action is provided by the use of small but effective amounts of supplemental wetting agents, such as in amounts of from about 0.02 grams per liter up to about 2 grams per liter, of which sodium lauryl sulfate or fluorinated wetting agents, such as FC-95, commercially available from 3M Company, are typical.

In accordance with the preferred process arrangement as illustrated in FIG. 3, the tubing upon emersion from the first stage electrical cleaning operation passes between a second guide roll and contact assembly 40, and enters into a second tubular chamber 42, disposed over a second receptacle 44 defining in combination the second stage cleaning station. The upper of the guide roll assembly 40 is electrically connected to a cycling switch 46, which in turn is electrically connected to a rectifier 48 to effect a negative or cathodic electrification of the tubing in the second stage. The opposite pole of the cycling switch 46 is connected to the tubular chamber 42 and to the rectifier 48 for positively or anodically electrifying the tubular chamber. In accordance with the arrangement shown in the second stage, the cycling switch is presettable to effect an intermittent cathodic electrification of the tubing for a prescribed time period, and thereafter an interruption of the current such as no current at all, followed again by a brief cathodic electrification. The interruption of the cathodic electrification of the workpiece has been found to further accelerate the solubilization of copper and dislodgment of particles from the surface thereof. During periods when the current is interrupted, a wetting and chemical undercutting action of the embedded carbon particles is attained in some instances due to the absence of evolution of hydrogen gas at the surface, facilitating a release of the interlocked embedded particles.

It will also be appreciated that the workpiece or tubing can be anodically charged, such as by the cycling or reversing switch 46, for brief time periods. The duration of the anodic electrification must be controlled to avoid any appreciable deplating of the brazing metal, particularly along the longitudinal edge or joint as indicated at 50 in FIG. 1. The use of anodic polarity of the workpiece during small portions of the electrocleaning cycle does not appreciably affect the efficiency and speed of the electrocleaning and because of the susceptibility of deplating the brazing material along the longitudinal joint, anodic electrification is preferably not employed.

The tubing 28, upon emergence from the second stage, passes between a guide and roll contact assembly 52 and enters into a tubular chamber 54 disposed over a third receptacle 56 arranged in a manner similar to that of stage one. The upper roll of the guide roll assembly is electrically connected to the negative terminal of a rectifier 58 to continuously cathodically charge the tubing, while the periphery of the tubular chamber 54 is anodically charged. The third stage electrocleaning step removes the residual remaining contaminating carbon on the tubing surfaces and also removes any surface discolorations present on the surface caused by current interruptions in the second stage section. In a typical operation, approximately 90% of the contaminating carbon is removed in the first stage, approximately 5 – 7% of the contaminating carbon particles are removed in the second stage, and substantially all of the remaining residual carbon is removed during the third stage. Because of the foregoing, it is preferred to use three separate stages to minimize carbon carry-over into the succeeding electroplating stations. For this purpose, the tubing passes from from the third stage cleaning operation to a rinse station including a tubular chamber 60 and a receptacle 62 by which a water rinsing of the surface of the tubing is effected employing conventional tap water or deionized water in one or a plurality of individual rinse treatments. The three-stage electrocleaning treatment normally employs substantially the same solution in each stage and the solutions can advantageously be counterflowed from the third stage to the second stage and from the second stage to the first stage to maintain the level of carbon contamination therein to the desired maximum level.

The tubing, after rinsing, having a bright electrocleaned copper surface, is thereafter transferred through one or a plurality of electroplating operations and terne coating operation to produce a corrosion resistant tubing in accordance with the process as more fully described in U.S. Pat. No. 3,875,027, the substance of which is incorporated herein by reference. Briefly stated, the cleaned tubing is electroplated to apply a plating of copper followed by a rinse and an electroplating of nickel, wherein the total thickness of the two primary platings does not exceed about 0.002 inch, and more usually, ranges from about 0.0007 to 0.0015 inch. The tubing thereafter passes into a molten bath of terne metal normally consisting of about 5 to about 25% tin and the balance lead, while amounts of tin of about 15% are usually preferred. The electroplated tube passes through a molten bath of the terne metal in a manner so as to deposit a coating of from about 0.05 to about 0.30 mil, and preferably a coating of a thickness of about 0.15 to 0.25 mil. By virtue of the electrocleaning process of the present invention, the primary copper and/or nickel primary electroplating, as well as the secondary terne metal coating, are continuous due to the absense of nonconductive embedded carbon particles in the tubing surface which would otherwise result in minute localized imperfections comprising weak points at which corrosive attack of the substrate occurs.

In order to further illustrate the benefits of the present invention, the following example is provided. It will be understood that the example is provided for illustrative purposes and is not intended to be limiting of the process as herein described and as set forth in the subjoined claims.

EXAMPLE

A three-stage pilot plant electrocleaning apparatus is prepared similar to that illustrated in FIG. 3 employing three receptacles, each formed with a tubular chamber of a length of 30 inches. Each stage is provided with an aqueous alkaline solution containing 8 ounces per gallon of sodium tetrapyrophosphate and 1.3 ounces per gallon of sodium hydroxide to provide a solution alkalinity of about pH 11. Electrical heating elements incorporated in each receptacle provided a control of the solution within a range of 145° to about 165° F.

A multi-ply copper brazed furnace brazed steel of a 3/16 inch diameter tube derived from the furnace brazing step is subjected to the three stage electrocleaning cycle by passage through the three chambers. The tubing is advanced through each station at a rate of 6.5 feet per minute. In the first stage, the tube is made continuously negative or cathodic at a current flow of 50 amps (385 ASF); in the second stage, the tubing is intermitently cathodically charged, followed by short periods of no current at all at a repetitive cycle of 5 seconds cathodic charge, 5 seconds no current, 5 seconds cathodic charge, etc., and at a total current during electrification periods of 34 amps (260 ASF); and finally, a continuous cathodic charge in the third stage at an amperage of 64 amps (490 ASF).

An inspection of the electrocleaned tube surface after water rinsing revealed a visible reduction in thickness of the copper coating and evidenced a polished as opposed to an etched or matched surface. Further inspection of the surface evidenced the substantial complete absence of any adherent or embedded residual carbon particles in the surface thereof.

While it will be apparent that the invention as herein described is well calculated to achieve the benefits and advantages hereinabove set forth, it will be appreciated that the invention is susceptible to modification, variation and change without departing from the spirit thereof.

What is claimed is:

1. A process for electrocleaning articles comprised of a copper surface stratum to remove embedded contaminating carbon particles in the surface thereof which comprises the steps of contacting the article with an aqueous alkaline solution containing an alkaline complexing agent of a type which provides for a solubilizing of copper and forms aqueous alkaline solution soluble copper complexes to maintain the solubilized copper in solution, cathodically electrifying the article for a period of time sufficient to effect a solubilization of a portion of the copper surface by forming solution soluble copper complexes in a magnitude sufficient to undercut and release the embedded carbon particles in the surface stratum, and thereafter extracting the article from said solution and rinsing said article to remove the residual solution thereon.

2. The process as defined in claim 1, in which said complexing agent is a compound selected from the group consisting of inorganic alkali metal phosphates including tetrapyrophosphates, trimetaphosphate, triphosphites, as well as mixtures thereof.

3. The process as defined in claim 1, in which said complexing agent is a compound selected from the group consisting of sodium gluconate, sodium salts of E.D.T.A., amino triacetic acid, hydroxyl ethyl amino diacetic acid, methyl amino diacetic acid, E.D. tetrapropionic acid, and glycine.

4. The process as defined in claim 1, in which said complexing agent is present in an amount of from about 10 up to about 100 grams per liter.

5. The process as defined in claim 1, in which said complexing agent is present in an amount of from about 30 up to about 60 grams per liter.

6. The process as defined in claim 1, in which the alkalinity of said solution is controlled within a pH ranging from about 9 up to about 12.

7. The process as defined in claim 1, in which the alkalinity of said solution is controlled at a pH of about 11.

8. The process as defined in claim 1, in which the temperature of said aqueous alkaline solution is controlled within a range of about 100° F up to about the boiling point of said solution.

9. The process as defined in claim 1, in which the temperature of said aqueous alkaline solution is controlled within a range of about 145° to about 165° F.

10. The process as defined in claim 1, in which the step of cathodically electrifying the article is performed to provide a current density of from about 75 up to about 600 amperes per square foot.

11. The process as defined in claim 1, in which the step of cathodically electrifying the article is performed to provide a current density of about 250 to about 450 amperes per square foot.

12. The process as defined in claim 1, in which said aqueous alkaline solution further contains a wetting agent present in an amount of about 0.02 up to about 2 grams per liter.

13. The process as defined in claim 1, in which said aqueous alkaline solution further includes an alkali metal hydroxide present in an amount to control the pH of said solution within a range of about 9 to about 12.

14. The process as defined in claim 1, in which said aqueous alkaline solution contains sodium hydroxide present in an amount sufficient to control the pH of said solution within a range of about 9 up to about 12.

15. The process as defined in claim 1, in which the step of cathodically electrifying the article while in contact with an aqueous alkaline solution is performed in a plurality of successive steps employing separate solutions.

16. The process as defined in claim 1, in which the step of cathodically electrifying the article while in contact with said aqueous alkaline solution is performed in a plurality of separate steps employing separate solutions and including the further step of intermittently electrifying the article while in contact with one of said solutions to effect a cathodic electrification thereof and intervening periods of a substantially neutral voltage.

17. The process as defined in claim 1, in which the step of cathodically electrifying the article while in contact with an aqueous alkaline solution is performed in three separate steps employing three separate solutions which are counterflowed.

18. In a process for making multi-ply tubing from copper coated strip rolled into a tubular form and brazed by heating to a temperature above the melting point of copper in a reducing atmosphere and in the presence of a carbonaceous film on the tube surface, the improvement including subjecting the brazed multi-ply tubing to an electrocleaning treatment to remove the embedded carbon contaminant particles from the surfaces thereof prior to subjecting the cleaned tubing to further electroplating operations, said electrocleaning treatment comprising the steps of contacting the surface of the tubing with an aqueous alkaline solution containing an alkaline complexing agent of a type which provides for a solubilization of copper and forms aqueous alkaline solution soluble copper complexes to maintain the solubilized copper in solution, cathodically electrifying the article for a period of time sufficient to effect a partial solubilization of the copper surface by forming solution soluble copper complexes to a degree sufficient to undercut and release the embedded carbon particles in the surface, and thereafter extracting the electrocleaned tubing from said solution and rinsing said tubing to remove any residual solution thereon.

* * * * *